United States Patent [19]

Redmayne

[11] 4,202,574

[45] May 13, 1980

[54] REFUSE CONTAINER LID LOCK

[76] Inventor: William L. Redmayne, 4902 N. Lexington, Tacoma, Wash. 98407

[21] Appl. No.: 3,289

[22] Filed: Jan. 15, 1979

[51] Int. Cl.[2] ..... E05C 3/14; E05C 3/22; E05C 19/16

[52] U.S. Cl. ..... 292/228; 16/DIG. 14; 220/230; 220/326; 292/54; 292/201; 292/288

[58] Field of Search ..... 220/326, 230; 292/201, 292/228, 288, 251.5, 54; 16/DIG. 14

[56] References Cited

U.S. PATENT DOCUMENTS

| | | | |
|---|---|---|---|
| 2,974,990 | 3/1961 | Mereness | 292/288 |
| 3,104,903 | 9/1963 | Futch | 220/326 |
| 3,152,716 | 10/1964 | Feldhahn | 16/DIG. 14 |
| 3,158,393 | 11/1964 | King | 292/288 |
| 3,275,363 | 9/1966 | Bates | 292/228 |
| 3,844,597 | 10/1974 | Elrod | 292/251.5 |
| 4,021,073 | 5/1977 | Manning | 292/228 |

FOREIGN PATENT DOCUMENTS

| | | | |
|---|---|---|---|
| 669485 | 4/1956 | United Kingdom | 220/326 |

*Primary Examiner*—George E. Lowrance

[57] ABSTRACT

This invention relates to a catch or lock mechanism used between a refuse or garbage can and the lid therefor. A substantially U-shaped bracket has the inner curve between its legs slidingly engaged with the undersurface of the lid bead carried by the lower edge of the lid. This may be by a threaded screw engaging with one leg of the U-shaped bracket and extending between the legs thereof to thereby form a sleeve sliding engaging the lid bead. Also, the U-shaped bracket may be movably carried by the U-shaped bracket or the can lid by the use of magnetic means. The U-shaped bracket preferably has a longer inner leg which is urged by spring or magnetic means into engagement under the bead at the top of the refuse can. The other leg of the U-shaped bracket is shorter and preferably terminates in an outwardly and horizontally extending portion for finger engagement thereof for releasing the lid from the can.

2 Claims, 7 Drawing Figures

REFUSE CONTAINER LID LOCK

BACKGROUND OF THE INVENTION

Prior art devices failed to provide catch means, between the refuse container and the lid, that was spring or magnetically loaded to lock or provided such spring loading in such a complicated and cumbersome manner as to be impractical. For example, many required external springs extending across or half-way across the top of the refuse container lid. Other devices required too much skill in the installing and were not thus saleable to the do-it-yourself trade.

The only prior art known to applicant is:

| PATENTEE | U.S. PAT. NO. | ISSUE DATE |
|---|---|---|
| L. H. Mereness | 2,974,990 | March 14, 1961 |
| C. H. King | 3,158,393 | Nov. 24, 1964 |
| M. C. Bates et al | 3,275,363 | Sept. 27, 1966 |

SUMMARY OF THE INVENTION

The most widely used refuse or garbage can comprises a tubular member with a bottom and a tubular side terminating in a bead around the upper peripheral edge. The lid is crowned and provided with a handle on the top and the side edges depend and telescopically slide over and fit the upper wall portion of the can and with a bead on the lower edge portion of the lid.

I provide a U-shaped bracket where the curved portion between the legs is slidingly engaged with the lower beaded portion of the lid. The U-shaped bracket is held in place by either magnetic means or by a threaded screw means adjustably extending from one leg of the U-shaped bracket toward the other and forming with the inner surface of the U-shaped bracket enough of a sleeve to engage with the lower beaded portion of the can lid. Also, the screw does not extend too far to interfere with the required limited turning movement of the U-shaped bracket relative to the beaded portion which supports it.

The U-shaped bracket is spring loaded by a spring, preferably welded to the inner surface of a leg of the U-shaped bracket, urging a leg of the U-shaped bracket into locking position under the beaded portion of the upper peripheral edge of the refuse can. Also, such a leg of U-shaped bracket can be urged by magnetic means into such position.

Other objects and advantages of this invention will become explicit and implicit as the description of this invention proceeds in connection with the accompanying drawings, wherein like reference numerals refer to like parts.

DESCRIPTION OF PREFERRED FORMS OF THE INVENTION

Figure 1:
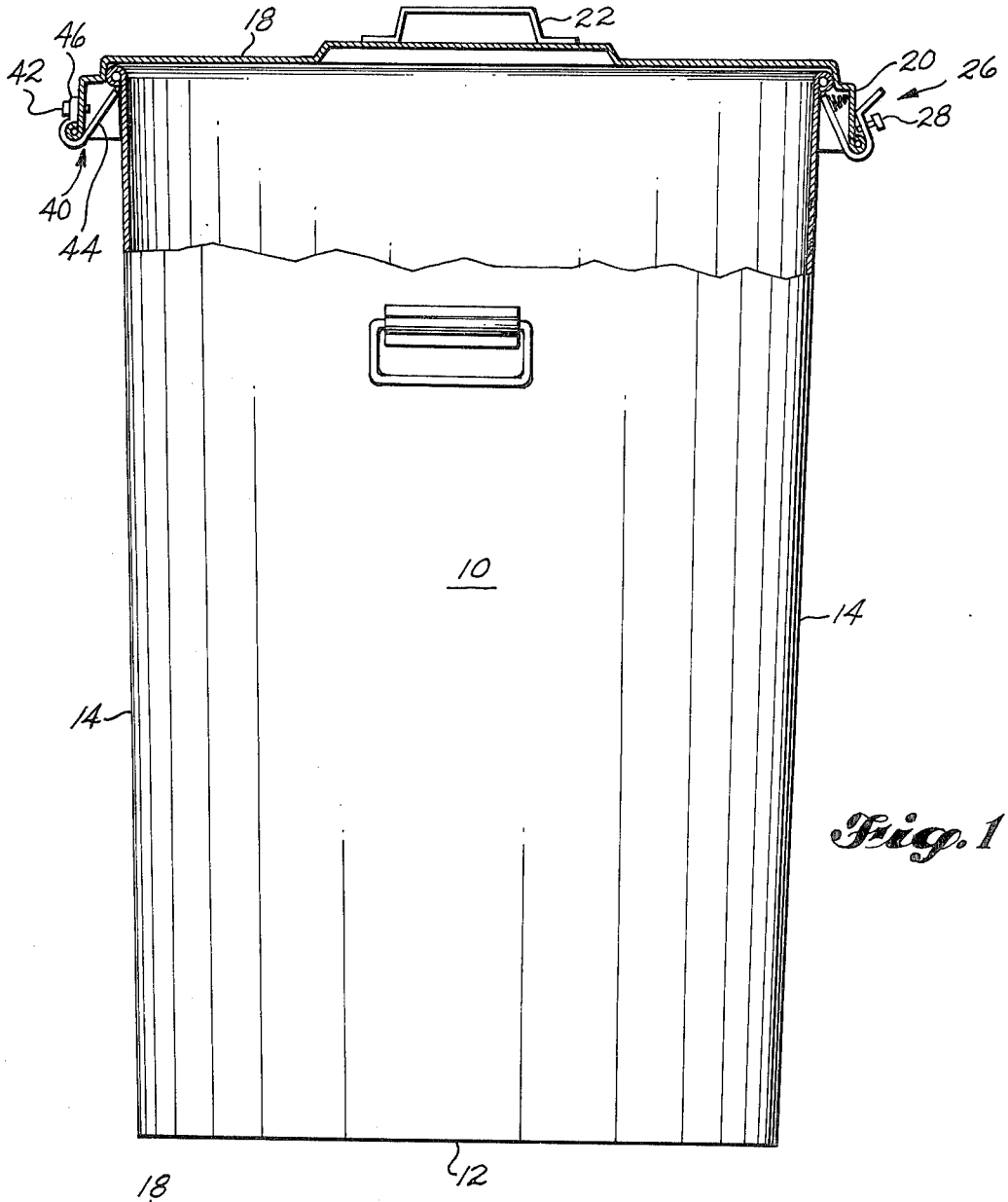
FIG. 1 is an elevational view, with parts in section, of a refuse can and lid and with an embodiment of my invention attached.

A standard garbage or refuse can 10 is made of galvanized sheet material, has a bottom 12, a cylindrical wall 14, and terminates in an upper beaded portion 16. The lid 18 has a depending side wall 20 which telescopes and fits over the upper beaded portion 16 of the can 10. Also, the lid 18 has a handle 22 for convenience in handling of the same. The depending side walls 20 of the lid 18 terminate in a lower beaded portion 24.

Figure 2:
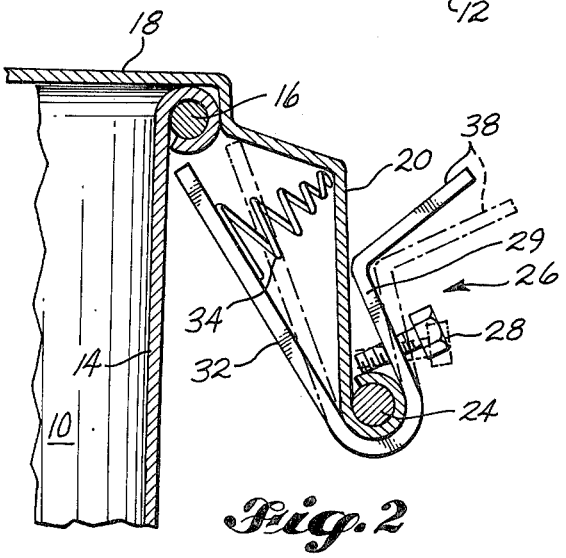
FIG. 2 is an enlarged fragmentary view of the portion of FIG. 1 relating to my invention.
Figure 3:
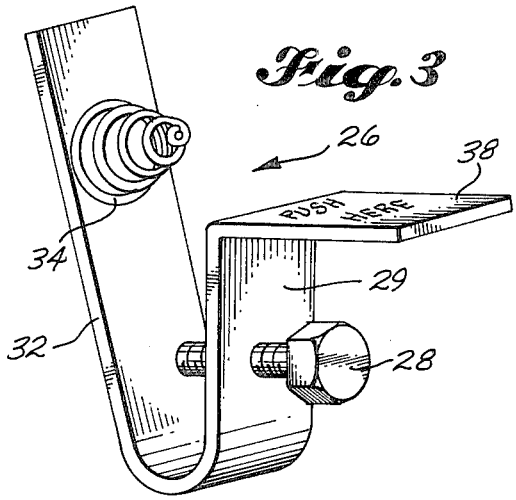
FIG. 3 is a detached view, on a still larger scale, of the form of my invention shown in FIGS. 1 and 2.

Referring more particularly to FIGS. 1–3, a U-shaped bracket 26 is of suitable size so that its inner wall surface at the juncture of its two legs provides an arced surface which slidingly fits against the external surface of the lower beaded portion 24 of the lid 18. Screw 28 is threadedly connected with the outer leg 29 and extends toward the inner leg 32. As the screw 28 is carried by one leg of bracket 26 and extends toward the other leg thereof, the U-shaped bracket is thereby mounted for relative turning movement relative to the lower beaded portion 24 by its U-shaped portion and by screw 28 forming part of a sleeve. To install my device, the screw 28 is moved outwardly and the inner surface of the curve of the U-shaped bracket 26 is placed against the lower beaded portion 24. Thereafter, the screw 28 is extended toward, but short of, inner leg 32 and thus U-shaped bracket 26 is mounted for sliding turning movement on the lower beaded portion 24. The inner leg 32 of the bracket 26 is of a length so its upper end portion may be moved under the inner edge of the upper beaded portion 16 of can 10 and to be angularly moved into close proximity to and under beaded portion 16 and then outwardly clear of the said beaded portion 16, both while the lid 18 is on the can 10. A compression spring 34 is preferably welded to the inner surface of the inner leg 32 and reacts against the inner surface of the depending wall 20 to urge the leg 32 into locking position under beaded upper portion 16 of can 10. The outer end portion of the other and outer leg 29 of bracket 26 terminates in a finger-engaging portion 38 which is preferably horizontally disposed when the device is in use.

The directly opposite side of lid 18 (see FIG. 1) is held locked by any sutiable device and as illustrated, comprises a U-shaped bracket 40 and a screw 42. The inside curved portion between the legs of the bracket 40 encompasses the lower beaded portion 24 and then screw 42 is turned in place and turned until it holds the outer leg 46 of the bracket 40 against the outer surface of depending wall 20 and the other and inner leg 44 of the bracket 40 angularly and in a position to be first disposed under the lower beaded portion 24. Thereafter, the lid 18 is angularly moved and the inner leg 32 of the bracket 26 is moved under a portion of the upper beaded portion 16 of can 10 and at a location diametrically opposite to that of the positioning of the U-shaped bracket 40.

In the form of this invention shown in FIGS. 1-3, a partial sleeve is formed by the arc of the bracket 26 and the screw 28, the latter extending through outer leg 29, extending toward but short of inner leg 32, and against a depending side wall 20 and above the lower beaded portion 24 of the lid 18. This partial sleeve retains U-shaped bracket 26 to the lid 18, without need of a hole in said lid 18, and allows enough movement of the bracket 26 so the inner end portion of the inner leg 32 can be moved into lid-locking position under bead 16 by spring 34 or moved out of locking position by manual depression of finger-engaging portion 38 of the bracket 26.

Figure 5:
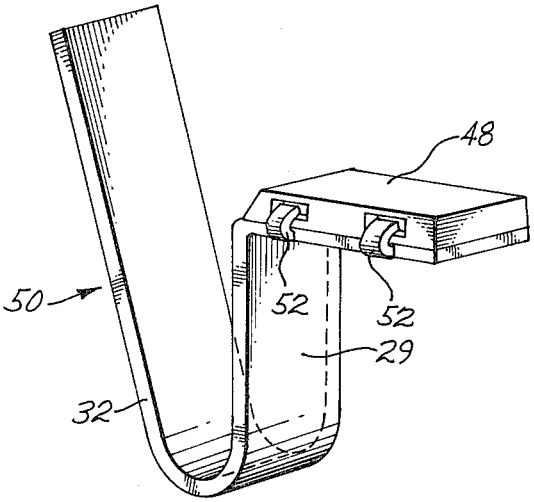
FIG. 5 is a perspective view, on a larger scale, of the form of the invention shown in FIG. 4.
Figure 4:
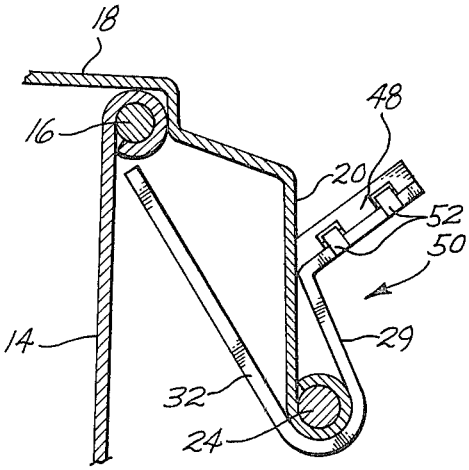
FIG. 4 is a detached perspective view of a modified form of my invention, showing permanent magnet means, carried by the U-shaped bracket, for holding the U-shaped bracket in place in respect to fragments of a refuse can and lid shown in section.

In the alternate form of the invention shown in FIGS. 4 and 5, the magnet 48 is preferably mechanically secured to the U-shaped bracket 50 by clamps 52. Such mechanical securance prevents misplacement of magnet 48. The magnet 48 urges the bracket 50 toward and upwardly of the lid depending side wall 20 of the lid 18. This upward movement urges inner leg 32 of the bracket 50 under the beaded portion 16 of lid 18 and thus spring 34 is not needed and not shown in FIGS. 4 and 5.

Figure 7:
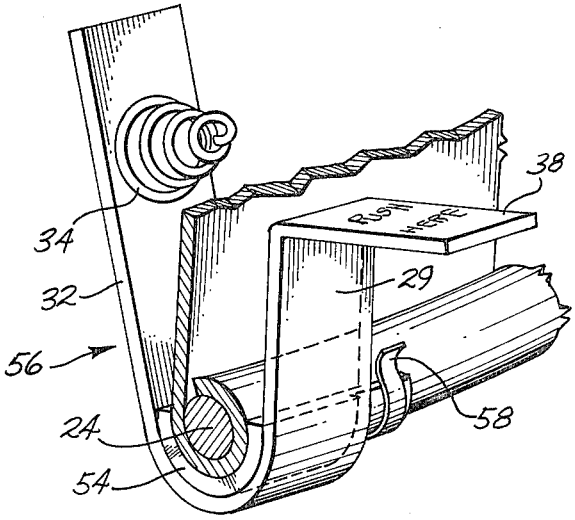
FIG. 7 is a detached perspective view, on a larger scale, of the structure of FIG. 6 and showing a fragment of the refuse can lid in section.
Figure 6:
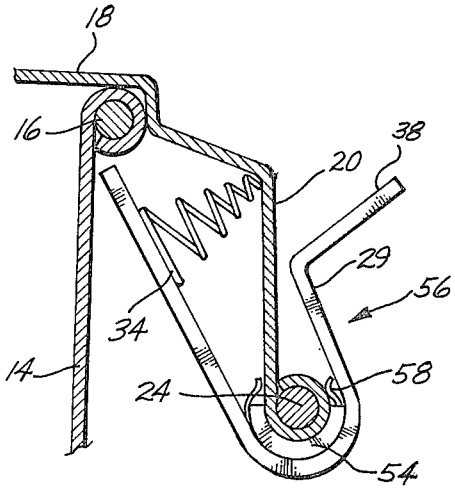
FIG. 6 is a view, similar to FIG. 4, of a still further modified form of my invention and illustrating a manner of securing the magnetic means to the refuse can lid.

In the alternative form of my invention shown in FIGS. 6 and 7, permanent magnet means 54 urges a U-shaped bracket 56, which may be the counterpart of the previous brackets, into engagement with the bead 24 of the garbage can lid 18. The permanent bar magnet member 54 is preferably mechanically attached to the bead 24 by any suitable means, such as bracket clip 58 which carries magnet 54 and is secured to the bead 24. The clip 58 merely physically holds the magnet 50 against bead 24 to prevent the magnet from being misplaced and then the magnetic flux of the magnet 50 holds the bracket 48 into sliding angular movement relation against bead 24.

THe various parts of the brackets in FIGS. 4 and 5 as well as in FIGS. 6 and 7 have the same functions as corresponding parts of the bracket 26 and they are given like numbers to incorporate the description of such parts and their functions by reference and without repetition.

Whether the permanent magnet 40 or 54 is physically carried by the U-shaped bracket 50 or by the bead 24, the end result is that the magnet draws the bead and the bracket together and the strength of the magnetic attraction between the bead and the bracket is by reason of the strength of the magnet which determines the strength of the securance between the U-shaped bracket and the bead.

Many refuse containers and their lids rely on the friction between the fit of the lid to the refuse container and this, of course, is not lost but augments the securance of the lid to the container by reason of the parts of this invention.

While I have shown clamps 52 and 58 to physically hold magnets 48 and 54 in place, adhesives maybe substituted.

SUMMARY

In general, and in view of the foregoing, it will now become obvious that this application discloses in combination with a cylindrical refuse container 10 having a cylindrical, vertical wall 14 terminating in an upper, circular bead 16 and a telescopingly fitting removable cover or lid 18 having a cylindrical, vertical wall terminating in a lower circular bead 24, a substantially U-shaped bracket 26, 50 or 58. The U-shaped bracket, in each instance, has an inner curved wall surface which, either directly or indirectly, slidingly interfits with the outer wall of the circular bead 24 of the removable cover or lid 18. Also, each of the U-shaped brackets has an outer leg, as 29, which terminates in a finger-engagable portion 38. This finger-engagable portion 38 is for the purpose of releasing the refuse container lid from the refuse container.

The means for manipulating the curved portion of the U-shaped bracket in engagement with the bead 24 is shown in FIGS. 1-3 as the curved portion of the U-shaped bracket combining with the screw 28 and in FIGS. 4 and 5, or 6 and 7 as permanent magnet means 48 or 54. The compression spring 34 extends between the longer or inner leg 32 of the U-shaped bracket and the removable cover or lid 18 and urges the longer leg 32 into engaging position below the bead 16 of the container 10. In FIGS. 4 and 5, magnetic means 48 urges the leg 32 of the bracket into engaging position below the bead 16.

Also, magnetic means, as permanent magnet 48 or 54, is used in place of the screw 28, to secure a U-shaped bracket, as bracket 48, or bracket 56 in sliding position relative to a beaded portion 24 of a refuse cover or lid 18. The magnet may be mechanically carried by either the U-shaped bracket or by the bead.

Obviously, changes may be made in the forms, dimensions and arrangements of the parts of this invention without departing from the principle thereof, the above setting forth only preferred forms of embodiment of this invention.

I claim:

1. In combination with a cylindrical refuse container having a cylindrical, vertical wall terminating in an upper, circular bead and a telescopically fitting and removable cover having a cylindrical, vertical cover terminating in a lower circular bead, a substantially U-shaped bracket having an inner curved wall surface slidingly interfitting the outer wall of the circular bead of the removable cover, having an inner leg, and having an outer leg extending outwardly and having its outer and portion substantially at right angles to said outer leg and functioning as a fingerengagable portion; means for maintaining said inner curved surface in detachable sliding engagement and in contact with said outer surface of said circular bead of the removable cover; and compression spring means, having one end portion thereof connected with said inner leg and having the other end portion thereof reacting against the vertical wall of the removable cover, urging the inner leg of the U-shaped bracket into engaging position with and below the bead of the refuse container.

2. The combination of claim 1, wherein the means for maintaining said inner curved surface in detachable sliding engagement with said outer surface of the circular bead of the removable cover comprises a screw threadedly engaging the outer leg, extending toward the inner leg of the U-shaped bracket, and slidingly contacting the bead of the container cover.

* * * * *